US009916954B2

(12) United States Patent
Helmreich et al.

(10) Patent No.: US 9,916,954 B2
(45) Date of Patent: Mar. 13, 2018

(54) ELECTRICAL SWITCHING CONTACT AND SWITCHING DEVICE HAVING THE SAME

(71) Applicants: TE Connectivity Germany GmbH, Bensheim (DE); Tyco Electronics Austria GmbH, Vienna (AT)

(72) Inventors: Johannes Helmreich, Zwettl (AT); Rudolf Mikl, Maria Ellend (AT); Titus Ziegler, Berlin (DE)

(73) Assignees: TE Connectivity Germany GmbH, Bensheim (DE); Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 15/000,615

(22) Filed: Jan. 19, 2016

(65) Prior Publication Data

US 2016/0133418 A1 May 12, 2016

Related U.S. Application Data

(63) Continuation of application No. PCT/EP2014/065414, filed on Jul. 17, 2014.

(30) Foreign Application Priority Data

Jul. 19, 2013 (DE) ..... 10 2013 214 209

(51) Int. Cl.

| | |
|---|---|
| ***H01H 67/02*** | (2006.01) |
| ***H01H 50/58*** | (2006.01) |
| ***H01H 1/28*** | (2006.01) |
| ***H01H 3/00*** | (2006.01) |
| *H01H 1/26* | (2006.01) |

(52) U.S. Cl.
CPC ..... *H01H 50/58* (2013.01); *H01H 1/28* (2013.01); *H01H 3/001* (2013.01); *H01H 2001/265* (2013.01)

(58) Field of Classification Search
CPC ..... H01H 50/54
USPC ..... 335/78, 83, 129
See application file for complete search history.

(56) References Cited

U.S. PATENT DOCUMENTS

| | | | |
|---|---|---|---|
| 820,303 A | 5/1906 | Hansen | |
| 2,480,127 A | 8/1949 | Frerer | |
| 4,096,460 A | 6/1978 | Gessinger et al. | |
| 6,788,176 B2 * | 9/2004 | Schmelz | H01H 51/2227 335/124 |

(Continued)

FOREIGN PATENT DOCUMENTS

| | | |
|---|---|---|
| CN | 101231923 A | 7/2008 |
| CN | 201117587 Y | 9/2008 |

(Continued)

OTHER PUBLICATIONS

PCT International Search Report and Written Opinion of the International Searching Authority, International Application No. PCT/EP2014/065414, dated Sep. 15, 2014, 9 pages.

(Continued)

*Primary Examiner* — Alexander Talpalatski
(74) *Attorney, Agent, or Firm* — Barley Snyder

(57) ABSTRACT

A switching contact is disclosed. The switching contact has an actuation section including a plurality of spring elements. The actuation section is less rigid in a first direction than an opposite second direction.

18 Claims, 9 Drawing Sheets

(56) References Cited

U.S. PATENT DOCUMENTS

| | | | | |
|---|---|---|---|---|
| 7,710,224 | B2 * | 5/2010 | Gruner | H01H 51/2281 335/129 |
| 7,750,769 | B2 * | 7/2010 | Minowa | H01H 50/56 335/128 |
| 7,956,710 | B2 * | 6/2011 | Minowa | H01H 50/642 335/129 |
| 7,982,562 | B2 * | 7/2011 | Yang | H01H 1/28 335/129 |
| 8,203,403 | B2 * | 6/2012 | Moeller | H01H 50/642 335/129 |
| 8,237,523 | B2 * | 8/2012 | Helmreich | H01H 50/548 200/400 |
| 2003/0112103 | A1 | 6/2003 | Schmelz | |
| 2004/0080388 | A1 | 4/2004 | Schmelz | |
| 2010/0123533 | A1 | 5/2010 | Helmreich | |

FOREIGN PATENT DOCUMENTS

| | | | |
|---|---|---|---|
| DE | 549661 | C | 4/1932 |
| DE | 1177234 | B | 9/1964 |
| DE | 1903075 | U | 10/1964 |
| DE | 3331900 | A1 | 4/1985 |
| EP | 0013991 | A1 | 8/1980 |

OTHER PUBLICATIONS

Abstract of EP0013991(A1), dated Aug. 6, 1980, 2 pages.
Abstract of DE3331900(A1), dated Apr. 4, 1985, 2 pages.
Abstract of CN101231923(A), dated Jul. 30, 2008, 2 pages.
Abstract of CN201117587, dated Sep. 17, 2008, 1 page.
English translation of Chinese First Office Action, dated Dec. 5, 2016, 8 pages.

* cited by examiner

ELECTRICAL SWITCHING CONTACT AND SWITCHING DEVICE HAVING THE SAME

CROSS-REFERENCE TO RELATED APPLICATIONS

This application is a continuation of PCT International Application No. PCT/EP2014/065414, filed Jul. 17, 2014, which claims priority under 35 U.S.C. §119 to German Application No. DE 102013214209.9, filed Jul. 19, 2013.

FIELD OF THE INVENTION

This invention relates to an electrical switching contact, and more particularly, to an electrical switching contact having a spring actuator section.

BACKGROUND

Electrical switching contacts and switching devices known in the prior art perform switching functions in electrical switching devices such as relays or other electrical switching elements. The switching devices have drive systems that move at least one switching contact via actuators, in order to bring a counter contact into electrically conductive contact or remove it therefrom. The actuators thus move one or more switching contacts in one switching direction towards the counter contacts or, in a counter switching device, away from them, and maintain a circuit formed by the contacts and counter contacts arranged at the switching contacts in a closed or open state.

In switching devices such as protectors or relays, contact forces acting in the switching direction are applied by drive systems driving the actuator that brings the contacts into contact with the counter contacts. In order to ensure secure, uninterrupted contact between the switching contacts and the counter contacts, in particular in the event of vibrations or pulses, the drive system and the actuator may be designed to move the switching contact with overtravel in the direction of the counter contact. A contact on the switching contact thus comes into contact with the counter contact before the actuator has reached its final position; a switching path followed by the switching element on the switching contact to transfer it from an open position of the switching contact into the closed position is shorter than an actuation path followed by the actuator acting on the switching contact in the same transition. In the closed state, the actuation section is thus subject to a force with which the contact of the switching contact is kept in contact with the counter contact.

To release the switching contact from the counter contact during the transition of the switching device from the closed to the open position, a resetting force must be generated counter to the switching direction. This resetting force may be generated by the actuator, as well as by a spring section of the switching contact.

Particularly in switching devices used for high currents, however, problems may arise during the transition from the closed into the open state if the switching contact or its contact element is welded to the counter contact. This may occur when short circuit currents arise from malfunctions of an apparatus containing the switching device. In some instances, the counter switching forces are not sufficient to release the switching contact from the counter contact.

SUMMARY

An object of the invention, among others, is to provide switching contacts and switching devices that can be reliably opened even under short circuit conditions. The disclosed switching contact has an actuation section including a plurality of spring elements. The actuation section is less rigid in a first direction than an opposite second direction

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a switching device. This invention may, however, be embodied in many different forms and should not be construed as limited to the embodiments set further herein; rather, these embodiments are provided so that this disclosure will be thorough and complete and still fully convey the scope of the invention to those skilled in the art.

Figure 1:
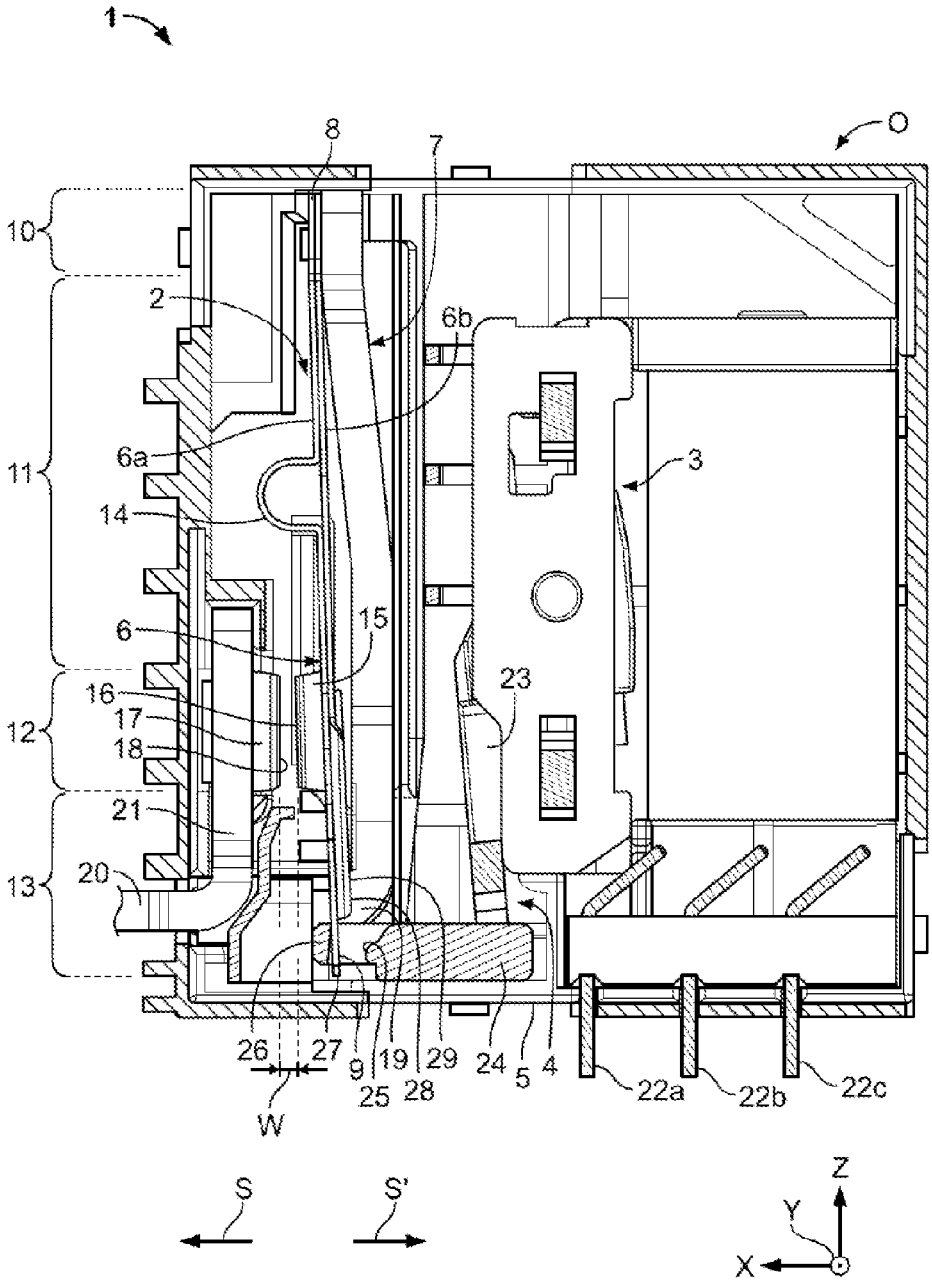
FIG. 1 is a schematic side view of a first embodiment of a switching device according to the invention with a first embodiment of a switching contact according to the invention in the open position.

FIG. 1 shows a schematic perspective view of a first embodiment of a switching device 1 according to the invention. The switching device 1 extends in a longitudinal direction X, a transverse direction Y perpendicular to the longitudinal direction X, and a height direction Z perpendicular to the longitudinal direction X and the transverse direction Y, forming together a Cartesian coordinate system. The switching device 1 comprises a switching contact assembly 2, a drive system 3, an actuation system 4, and a housing 5. The major components of the invention will now be described in greater detail.

The switching contact assembly 2 comprises an electrical switching contact 6 and a support 7. The switching contact 6 comprises a first spring element 6*a* and an additional spring element 6*b*, and extends from an attachment end 8 to an actuation end 9. In the area of the attachment end 8, the switching contact 6 has an attachment section 10, in which the switching contact 6 is attached to the support 7, e.g., by attaching the first spring element 6*a* and the additional spring element 6*b* close together on the support 7, as in this embodiment. For example, the first spring element 6*a* and the additional spring element 6*b* may be force- or form-fitting with the support 7. In this case, the attachment section 10 is riveted to the support 7.

A spring section 11, in which the first spring element 6*a* and the additional spring element 6*b* run substantially parallel to one another, is attached to the attachment section 10. A contact section 12, followed by an actuation section 13, on which the attachment end 9 is formed, is attached to the spring section 11. In the spring section 11, the first spring element 6*a* has a bend 14 influencing the spring properties of the spring section 11. In the contact section 12, a contact element 15 that forms a contact element surface 16, configured in a switching direction S so as to be able to be brought together with a counter contact element surface 18 that is formed by a counter contact element 17, is arranged on the switching contact 6. In a counter switching direction S', the contact element 15 can be separated from the counter contact element 17.

Figure 2:
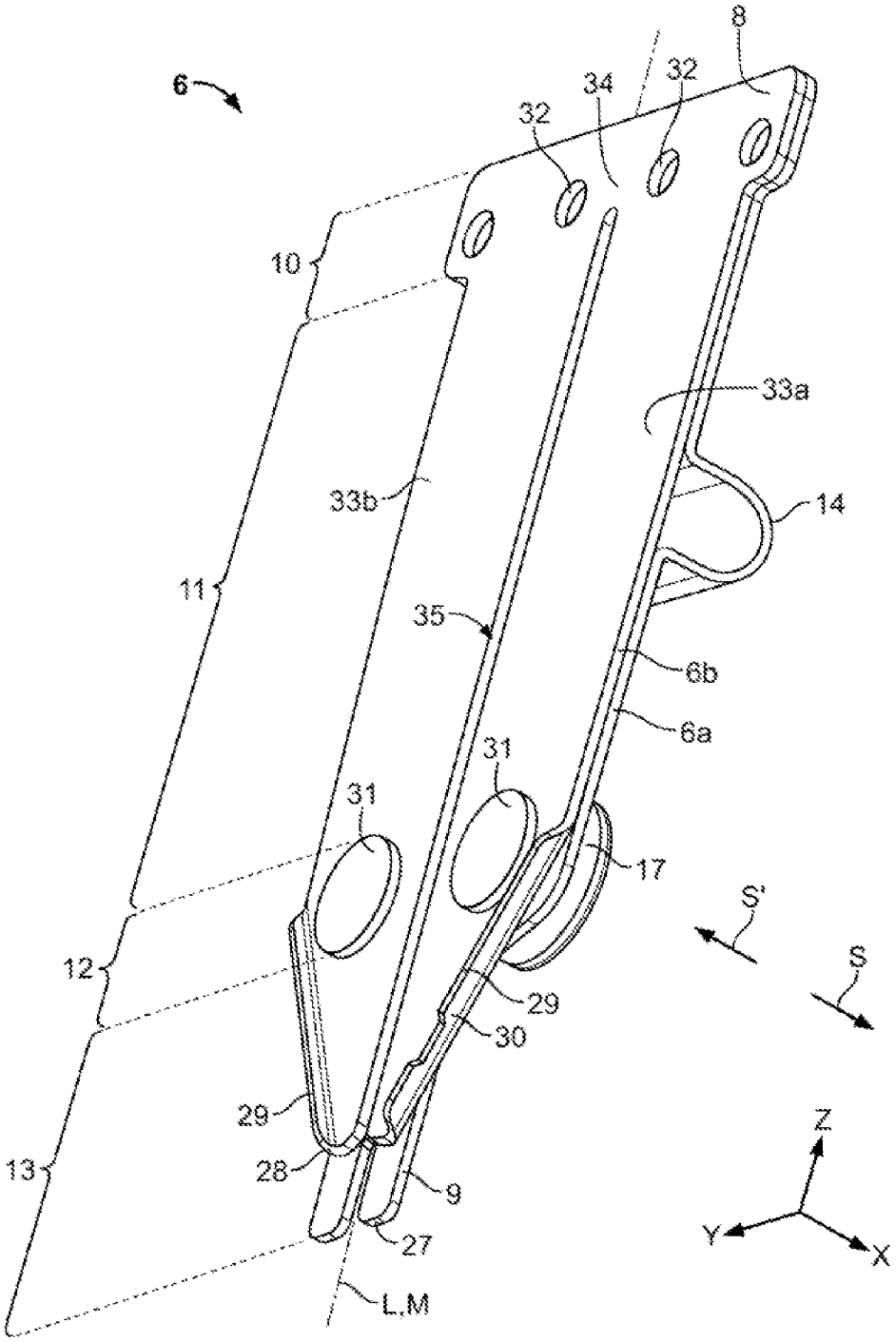
FIG. 2 is a schematic perspective view of the switching contact shown in FIG. 1.

A schematic perspective view of the switching contact 6 is shown in FIG. 2. In the area of the actuation section 13, a free end 27 of the first spring element 6*a* protrudes beyond another free end 28 of the additional spring element 6*b*. Thus, the actuation end 9 formed by the first spring element 6*a* is free. From the additional free end 28 to a point at which the first spring element 6*a* and the additional spring element 6*b* are connected in the contact section 12, a brace structure 29 extends along the additional contact 6*b*. The brace structure 29 is formed as an on-bend of an edge area 30 of the additional spring element 6*b* facing substantially against the switching direction S'.

Additionally, the additional spring element 6*b* widens from the additional free end 28 to the actuation section 12; on the other hand, the spring element 6*a* is substantially linear in this area and narrower than the additional spring element 6*b*. Because the additional spring element 6*b* has the brace structure 29 and/or is wider than the first spring element 6*a*, the additional spring element 6*b* is more rigid than the first spring element 6*a*, at least in the actuation section 13.

In the contact section 12, for example, two of the counter contact elements 17 are attached to the switching contact 6 with connection means 31. The connection means 31 may be, e.g., screws, rivets, etc. Thus, the first spring element 6*a* and the second spring element 6*b* may be force-fitted and/or form-fitted at least at one point in the contact section 12. From the contact section 12, the two spring elements 6*a* and 6*b* run in contact with one another and with substantially the same outer contour, apart from the area in which the bend 14 is arranged, up to the attachment section 10. In the attachment section 10, the series of attachment openings 32 are formed, in which the switching contact 6 can be connected using form fitting elements, e.g., rivets, and simultaneously the first spring element 6*a* can be connected with the additional spring element 6*b*.

Additionally, FIG. 2 shows that the switching contact 6 forms a first switching unit 33*a* and a second, or at least one additional, switching unit 33*b*, which are connected in a bridge-like connection area 34 in the attachment section 10 and separated from one another by a slit 35 running along a central axis M extending parallel to the longitudinal extension L of the switching contact 6, and are thus each independently movable from the connection area up to the actuation end 9. The first switching unit 33*a* and the additional switching unit 33*b* thus each comprise an attachment section 10, a spring section 11, a contact section 12, and an actuation section 13.

As shown in FIG. 1, an electrical connection 19 is formed on the support 7 and an electrical counter connection 20, also leading outside the housing 5, is formed on a counter support 21 containing the counter contact element 17. The electrical connection 19 and the electrical counter connection 20 may be designed as contact pins, solder tails, or other electrical connections known to those with ordinary skill in the art.

The drive system 3 is configured, for example, as an electromotive drive with an electrical coil, a magnetic core, and a yoke, and has three control connections 22*a*, 22*b*, and 22*c*, via which the drive system 3 can be supplied with electrical control, supply, or switching voltage. The supply connections 22 may be designed as contact pins, solder tails, etc.

The actuation system 4 comprises an actuator in the form of a slider 24, which is driven via a hinged armature 23 interacting with the drive system 3. The slider 24 is received on the body, and is movable substantially parallel to the mating direction S or the counter mating direction S', and has a make contact 25 and a break contact 26 as actuators, which are spaced apart substantially parallel to the switching direction S or the counter switching direction S' by an actuation distance d. The make contact 25 provides an actuation surface facing substantially in the switching direction S and the break contact 26 provides an actuation surface facing substantially against the switching direction S, i.e., in the counter switching direction S', as shown in FIG. 1.

The housing 5 contains the switching contact assembly 2, the drive system 3, and the actuation system 4.

The operation of the switching device 1 will now be described with reference to FIGS. 1-3.

In an open position O of the switching device 1, shown in FIG. 1, the contact element surface 16 is kept at a distance from the counter contact element surface 18 by means of a switching path W. The electrical connection 19 is conductively connected with the switching contact 6 and the contact element 15 arranged thereon, and serves to connect electrical components to it outside of the switching device 1.

Figure 3:
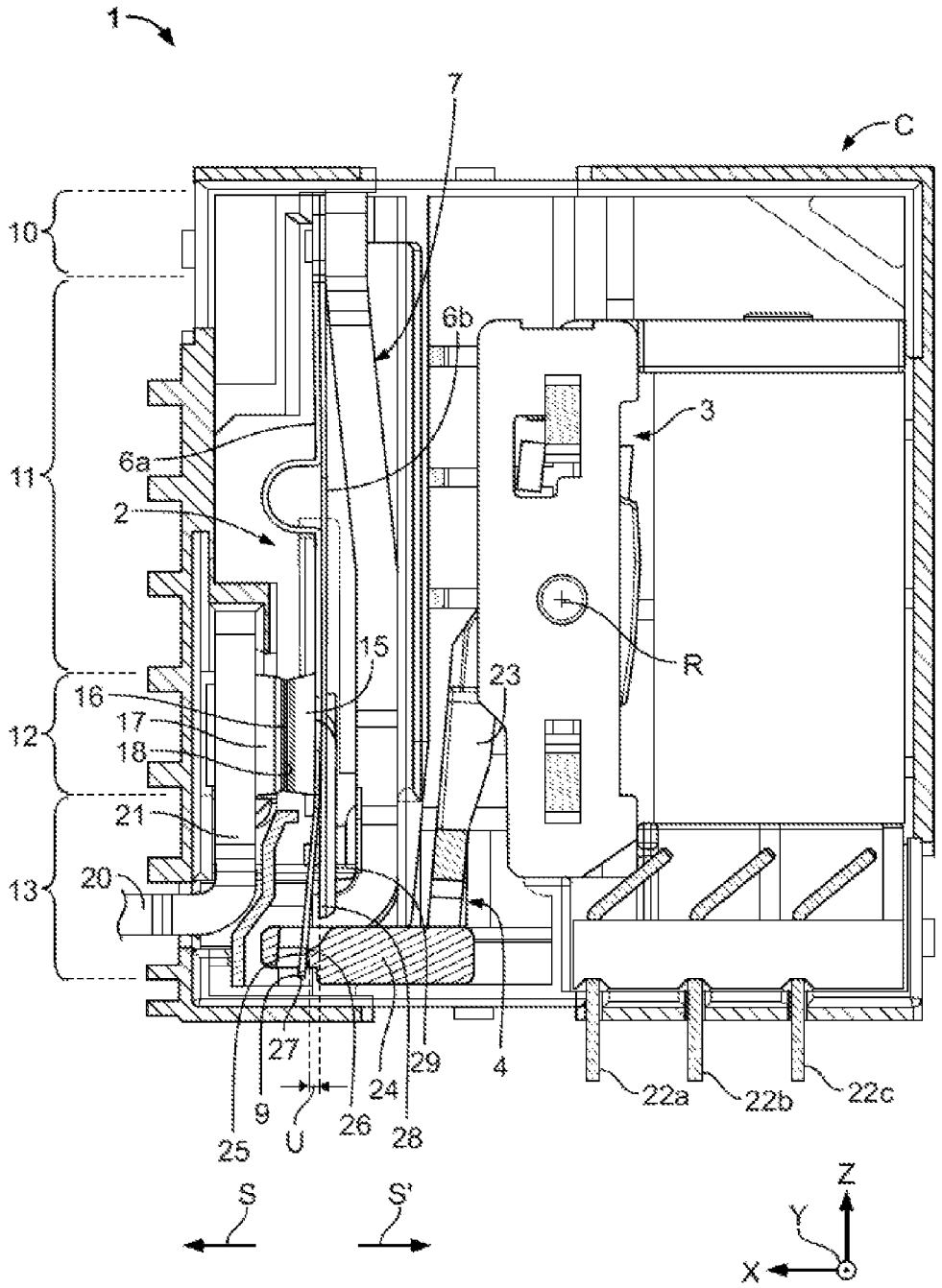
FIG. 3 is a schematic side view of the switching device shown in FIG. 1 in a closed position.

FIG. 3 shows a schematic perspective view of the switching device 1 in the closed position C. The drive system 3 has turned the hinged armature 23 around its rotational axis R to such an extent that it has moved the slider 24 in the switching direction S up to the closed position C. The contact 16 has traversed the switching path W whilst abutting the make contact 25 and guided by it, and abuts the counter contact element 17. The make contact 25 presses the switching contact 6 in the area of the actuation end 9 in the switching direction S with a switching force Fs. Beyond the switching path W, the slider 24 has executed an overtravel U in the switching direction S from the open position, thus raising the actuation end 27 away from the additional free end 28. Thus, the contact element surface 16 of the contact element 15 is held on the counter contact element surface 18 of the counter contact element 17 under spring tension from the actuation section 13 of the first spring element 6*a*. The actuation section 13 of the first spring element 6*a* forms an overtravel spring.

The break contact 26 moves the switching contact 6 in the area of the actuation end 9 with a counter switching force Fs' in the counter switching direction S', to move it to the open position, as shown in FIG. 1. Together with a spring force Ff exercised by the spring section 11 of the switching contact 6, the switching force Fs and counter switching force Fs' are added to a counter resetting force FR' in the switching direction S or a resetting force FR acting in the counter switching direction S'.

In the open position shown in FIG. 1, the actuation section 13 of the first spring element 6*a* abuts the actuation section 13 of the additional spring element 6*b*. The additional spring element 6*b* thus forms a support section in the actuation section 6*b*, in which it supports the actuation section 13 of the first spring element 6*a* in the counter switching direction S' when the contact elements 15 and 17 are opened or separated, i.e., during the transition of the switching contact 6 from the closed position C to the open position O. Thus, an overtravel can be generated in the switching direction S, and the increased rigidity can be used in the counter switching direction S' in order to reliably bring the contact elements 15 and 16 together or to separate them, and to break open any welds between the contact element surfaces 17 and 18.

Figure 4:
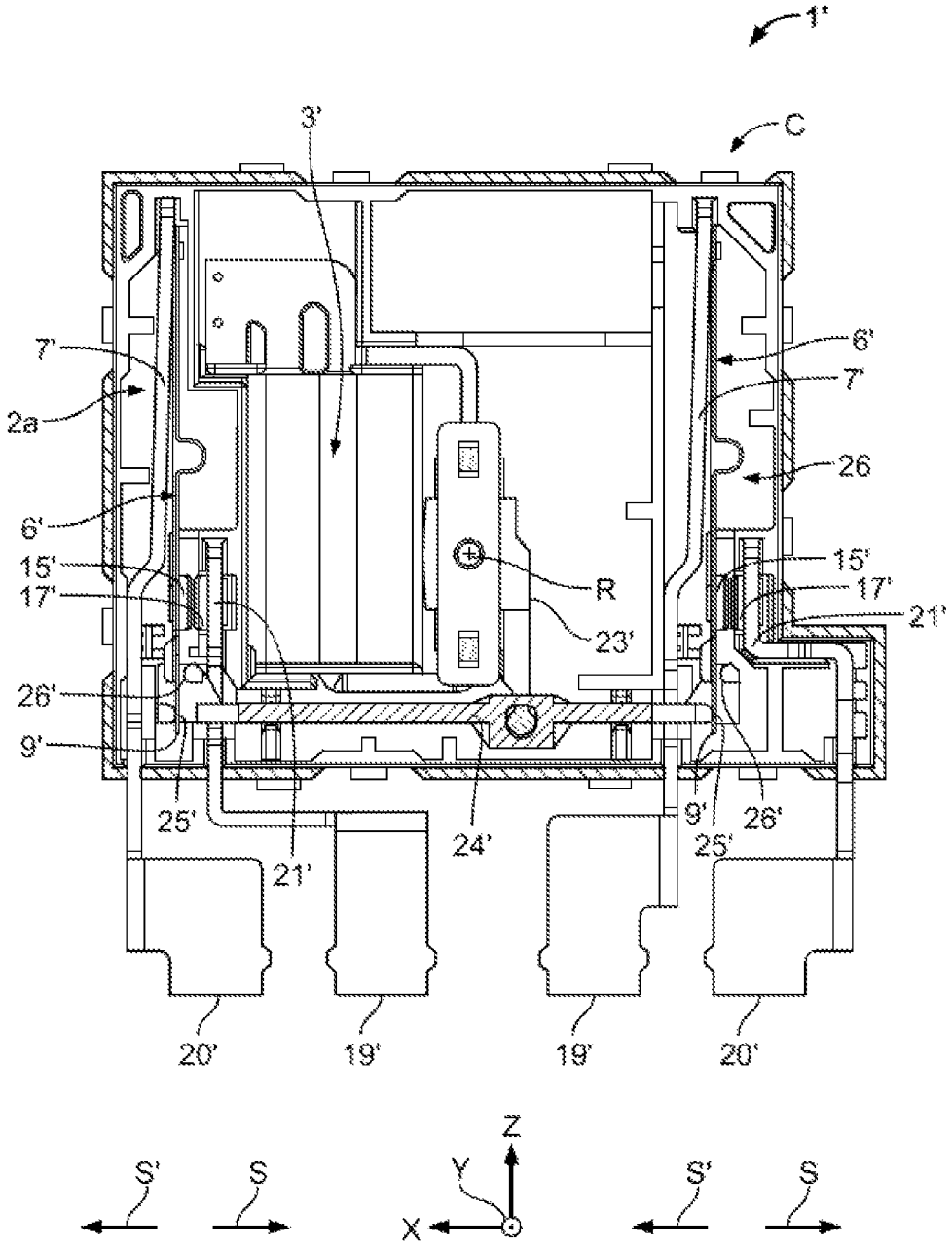
FIG. 4 is a schematic side view of a second embodiment of a switching device according to the invention with a second embodiment of switching contacts according to the invention in the open position.

FIG. 4 shows a schematic side view of a second embodiment of a switching device 1' according to the invention. Unlike the switching device 1, the switching device 1' has a first switching contact assembly 2*a* and an additional switching contact assembly 2*b*, which each comprise a switching contact 6' according to the invention, a support 7', and a counter support 21 with corresponding contact elements 15' and 17' as well as corresponding electrical connections 19' and counter connections 20'.

A central drive unit 3' of the switching device 1' drives a hinged armature 23' that moves a slider 24'. The slider 24' respectively has a make contact 25' and a break contact 26' for one of the two switching contact assemblies 2*a* and 2*b*. In the closed position shown in FIG. 4, the slider 24', with the make contact 25', buts the actuation ends 9' of the switching contacts 6' of each of the switching contact assemblies 2' to move the switching contacts 6' in the switching direction S until the contact elements 15' of the two switching contact assemblies 2*a* and 2*b* abut the corresponding counter contact elements 17'.

Figure 5:
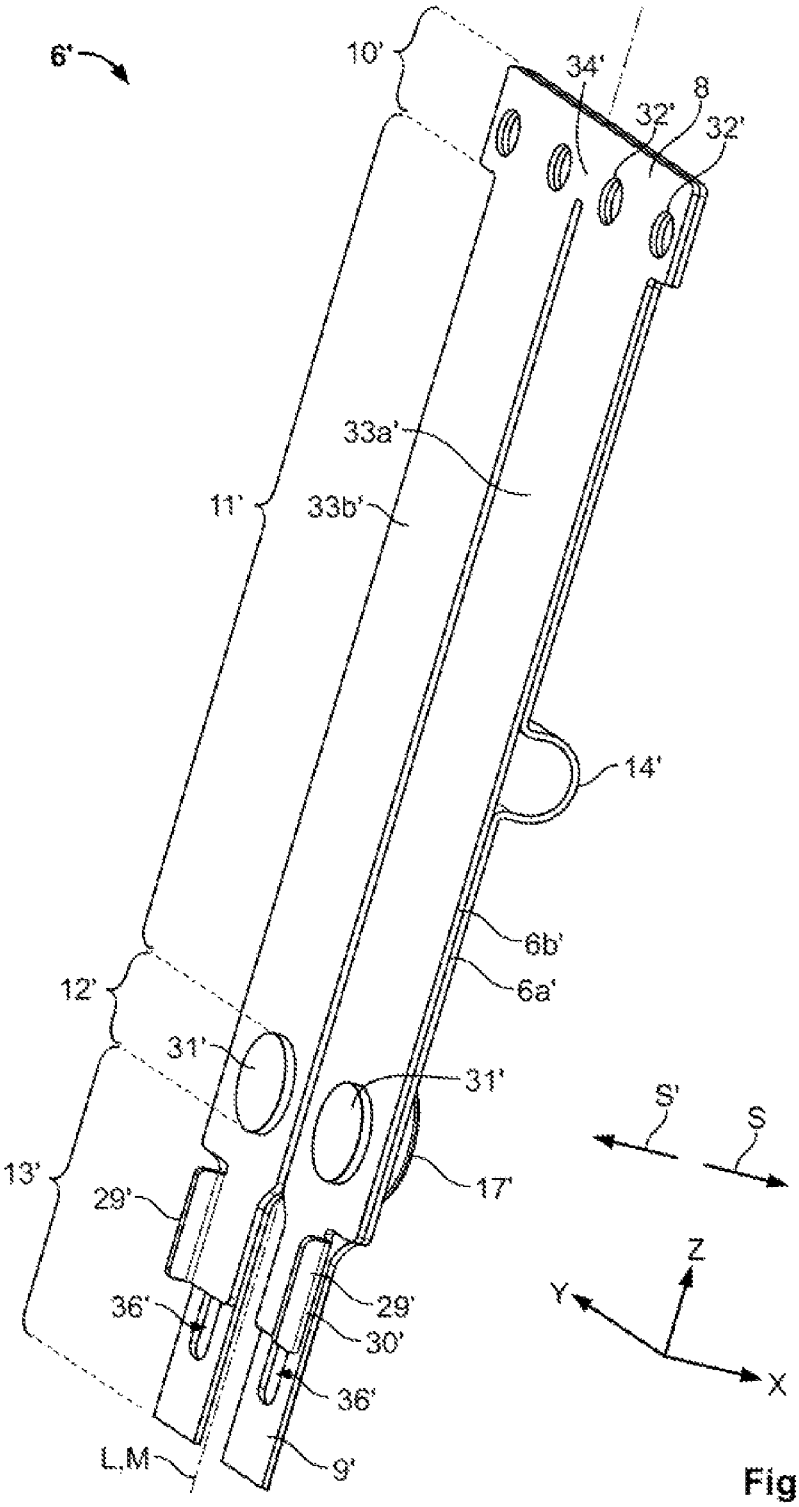
FIG. 5 is a schematic perspective view of the switching contact shown in FIG. 4.

FIG. 5 shows a schematic perspective view of the second embodiment of a switching device 6' according to the invention. Like the switching contact 6, the switching contact 6' comprises a first spring element 6*a*' and an additional spring element 6*b*', which each comprise an attachment section 10', a spring section 11', a contact section 12', and an actuation section 13', and, together, form a first switching unit 33*a*' and an additional switching unit 33*b*', which are connected via a connection area 34' in the attachment section 10'.

Unlike the switching contact 6, the first spring element 6*a*' and the second spring element 6*b*' of the switching contact 6' run on top of one another over substantially the same width as measured in the transverse direction Y. A brace structure 29' in the form of a bend of its edge area 30' running substantially parallel to the longitudinal extension L or central axis M is formed on the first spring element 6*a*'. In the actuation section 13', the first spring element 6*a*' is equipped with a weakening structure 36 in the form of a slit running along the actuation section 13' substantially up to the actuation end 9. The weakening structure 36 helps to reduce the rigidity of the first spring element 6*a*' in the actuation section 13 compared to the rigidity of the additional spring element 6*b*' in the actuation section 13' or to increase its elasticity.

Figure 6:
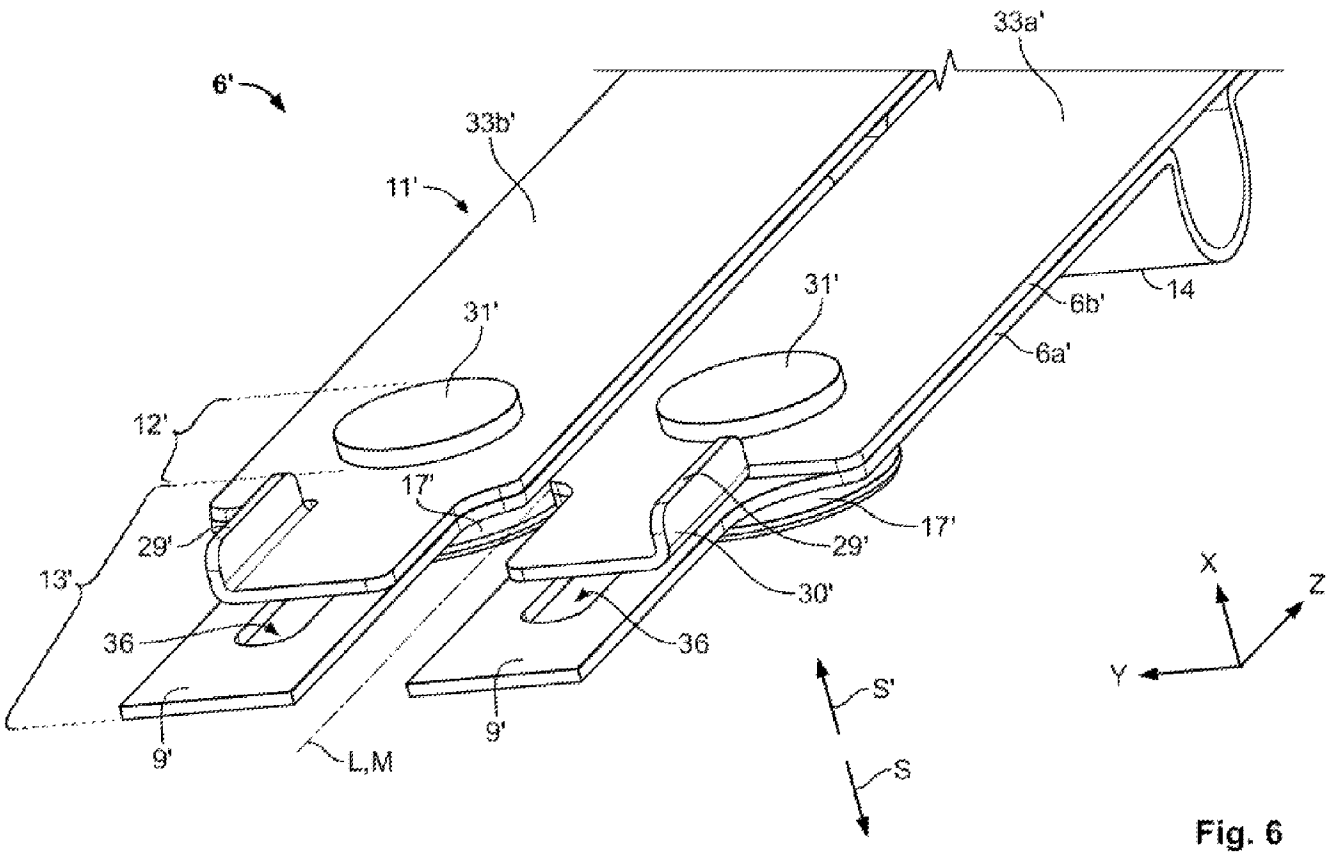
FIG. 6 is a detailed schematic perspective view of the switching contact shown in FIG. 5.

FIG. 6 shows a schematic perspective view of the contact section 12' and the actuation section 13', as well as part of the spring section 11' of the switching contact 6*a* shown in FIG. 5. This shows that the two spring elements 6*a*' and 6*b*' can be stamped out of sheet metal with substantially the same thickness. When assembled, the spring elements 6*a*' and 6*b*' may be formed with the same outer contours and substantially cover one another up to the actuation section 13'. In the actuation section 13', on the other hand, the brace structure 29 or 29' and the weakening structure 36 may contribute to giving the first spring element 6'*a* less rigidity, at least in the switching direction S, than the additional spring element 6*b*'.

Figure 7:
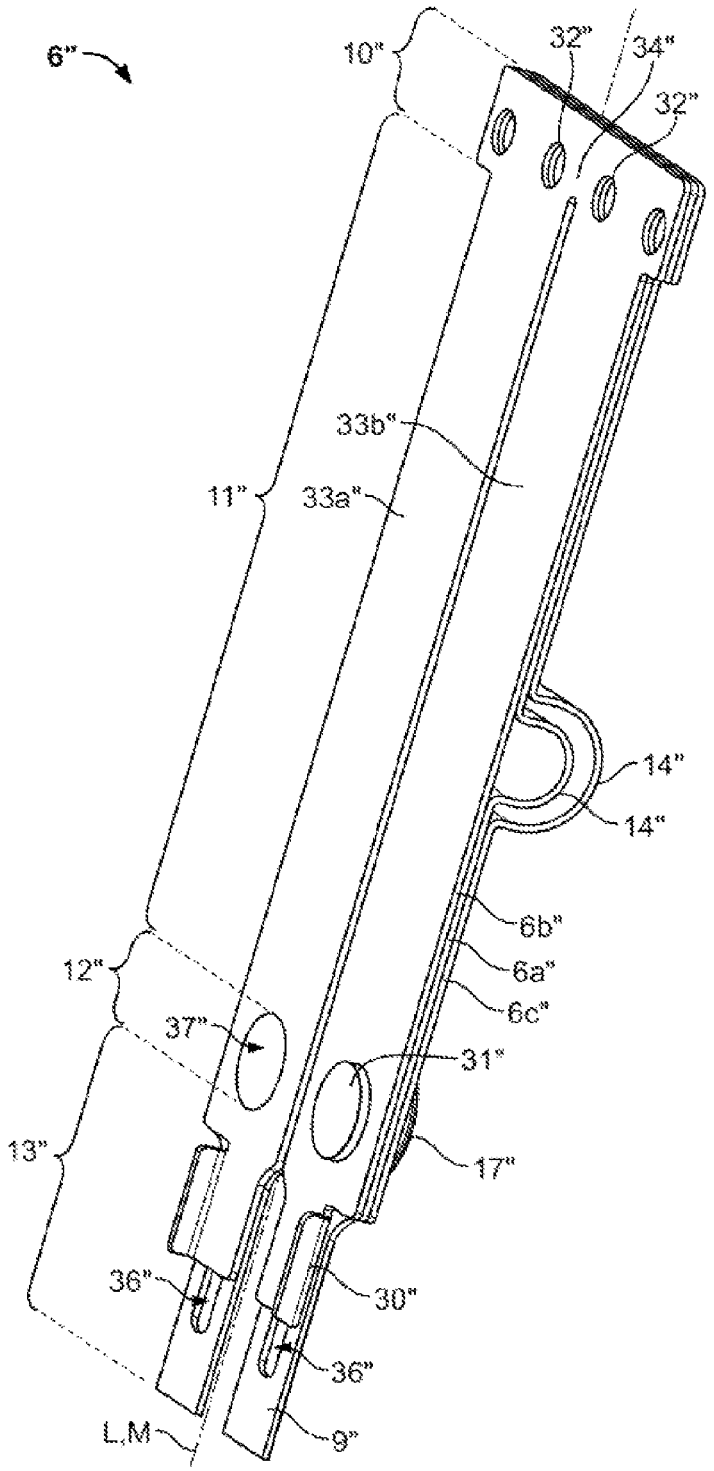
FIG. 7 is a schematic perspective view of a third embodiment of a switching contact according to the invention.

FIG. 7 shows a third embodiment of a switching contact 6" according to the invention. Like the switching contact 6', the switching contact 6" has an attachment section 10', a spring section 11", a contact section 12", an actuation section 13", and forms a first switching unit 33*a*" and a second switching unit 33*b*". Unlike the switching contacts 6 and 6', in addition to a first spring element 6*a*" and a second spring element 6*b*", the switching contact 6" also comprises an additional spring element 6*c*", extending from the attachment section 10" beyond the contact section 12" into the actuation section 13". The first spring element 6*a*" is sandwiched between the additional spring element 6*b*" and the additional spring element 6*c*" in this overlapping area. Thus, the spring section 11" of the switching contact 6" has a greater spring stiffness than the spring sections 11' and 11" of the switching contacts 6' and 6", as well as two bends 14", which are each formed on the first spring element 6*a*" and the additional spring element 6*c*".

Figure 8:
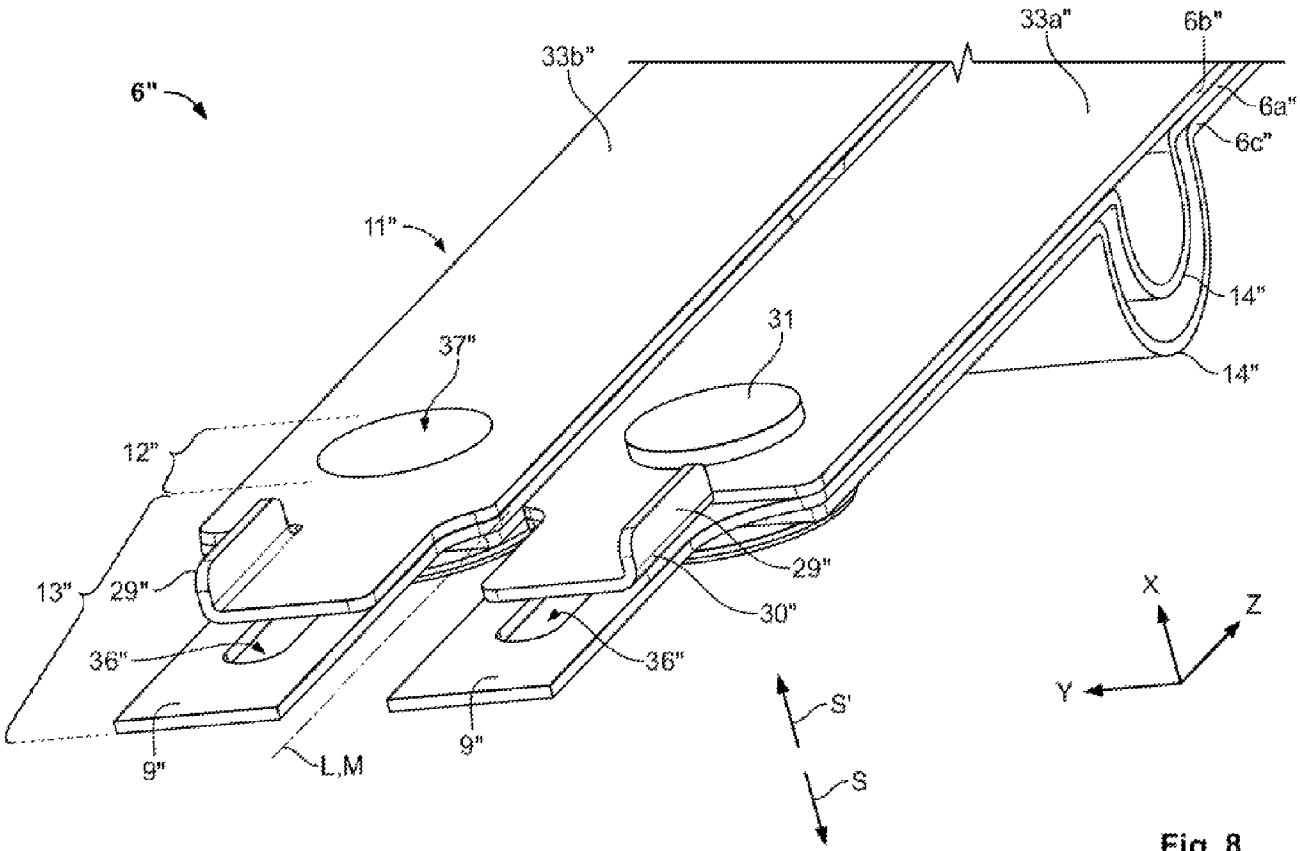
FIG. 8 is a detailed schematic perspective view of the switching contact shown in FIG. 7.

FIG. 8 shows, in particular, a schematic perspective view of the actuation section 13" and the contact section 12", as well as part of the spring section 11" of the switching contact 6". This makes clear that the spring elements 6*a*", 6*b*", and 6*c*" may have substantially the same outer contour and cover each other from the attachment section 34" beyond the contact section 12" and into the actuation section 13". The additional spring element 6*c*" ends substantially slightly above or below the contact section 12" in the height direction Z, such that the first spring element 6*a*" and the additional spring element 6*b*" in the actuation section 13", together with the brace structure 29", the weakening structure 36", and the actuation end 9" formed thereon are substantially free.

Figure 9:
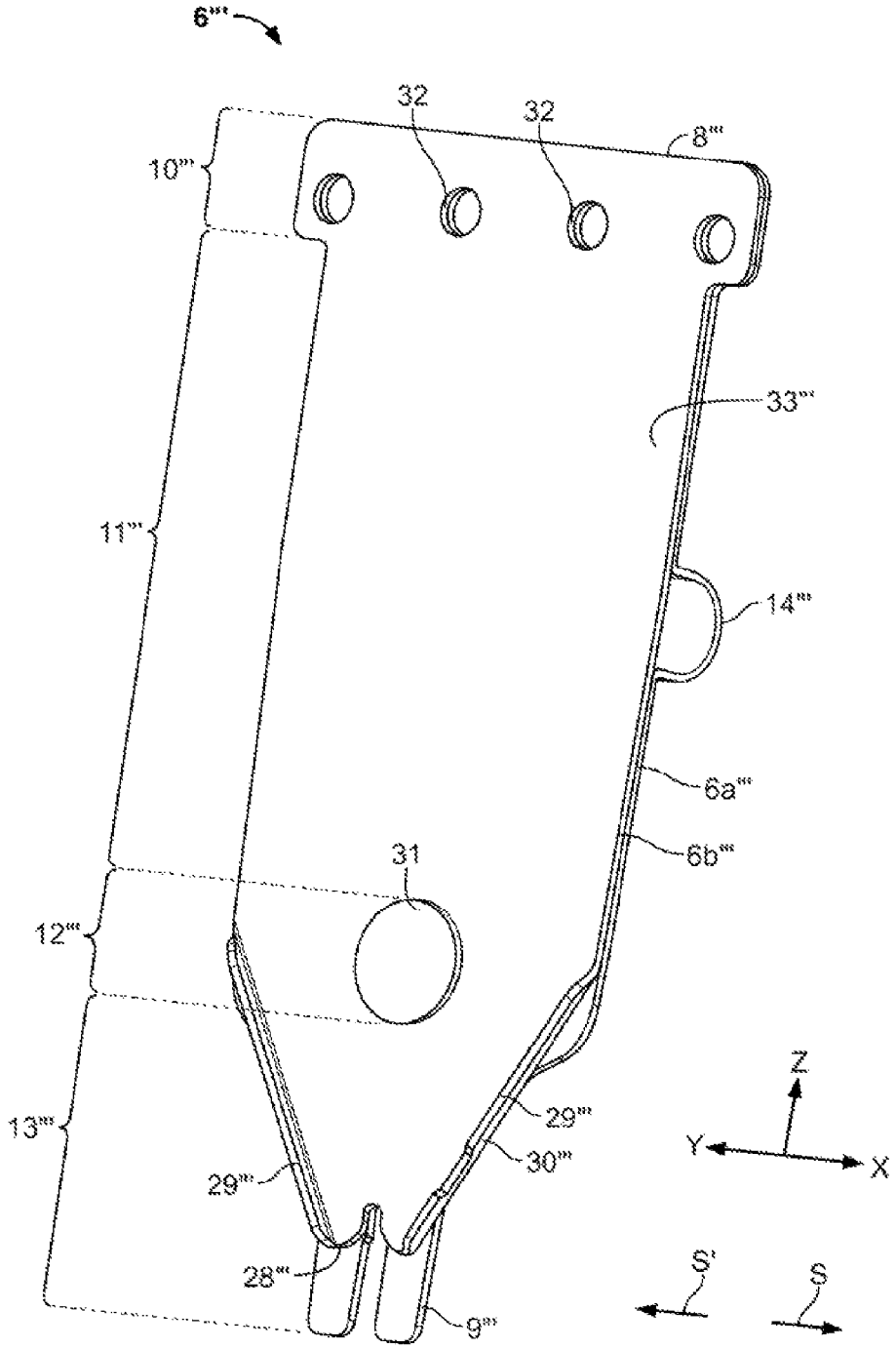
FIG. 9 is a schematic perspective view of a fourth embodiment of a switching contact according to the invention.

FIG. 9 shows a fourth embodiment of a switching contact 6" according to the invention. Like the switching contact 6, the switching contact 6'" has an attachment section 10'", a spring section 11'", a contact section 12'", and an actuation section 13'", formed by a first switching spring element 6*a*'" and a second spring element 6*b*'". Unlike the switching contacts 6, 6', and 6", the switching contact 6'" has only one switching unit 33'", which holds one contact element 17'".

Deviations from the aforementioned embodiments are possible within the idea of the invention. Thus, a switching device 1, 1' according to the invention may have any number of the switching contact assemblies 2, 2', 2*a*, 2*b*, drive systems 3, 3', and actuation systems 4, 4' configured to meet the respective requirements. The housing 5, 5' may be configured to meet the respective requirements in order to contain the switching contact assemblies 2, 2', 2*a*, 2*b*, drive systems 3, 3', and actuation systems 4, 4'.

The switching contact assemblies 2, 2', 2*a*, 2*b* may have switching contacts 6, 6', 6", 6'" having any number of, e.g., leaf spring-like, spring elements 6*a*, 6*a*', 6*b*, 6*b*', 6*c*, 6*a*'", 6*b*'", as well as corresponding supports 7, and form attachment ends 8, 8', 8", 8'", actuation ends 9, 9', 9", 9'", attachment sections 10, 10', 10", 10'", spring sections 11, 11', 11", 11'", contact sections 12, 12', 12", 12'", actuation sections 13, 13', 13", 13'", bends 14, 14', 14", 14'", contact elements 15, 15', 15", 15'", and contact element surfaces 16, 16', 16", 16'", each configured to meet the respective requirements. Accordingly, the counter contact elements 17, 17', 17", 17'" may form counter contact element surfaces 18, 18', 18", 18'" meeting the respective requirements. Electrical connections 19, 19', 19", 19'" and counter contacts 20, 20', 20", 20"' may be configured or arranged to meet the respective requirements. Counter supports 21 may be configured according to the respective requirements in order to bear counter contact elements 17, 17', 17", 17"'. Free ends 27, 27', 27", 27"', 28, 28', 28", 28"' brace structures 29, 29', 29", 29"', edge areas 30, 30', 30", 30"', connection means 31, and attachment openings 32 may be present in any number and configured and arranged to meet the respective requirements.

Additionally, a switching contact 6, 6', 6", 6"' according to the invention may form any number of switching units 33*a*, 33*a'*, 33*a"*, 33*b*, 33*b'*, 33*b"*, 33"', which may be connected in a connection area 34, 34', 34" and separated by a slit 35, 35', 35". Weakening structures 36, 36', 36" and connection openings 37, 37', 37", 37"' may be configured or arranged to meet the respective requirements.

Additionally, any number of hinged armatures 23, 23', sliders 24, 24', make contacts 25, 25', and break contacts 26, 26' may be configured and arranged to meet the respective requirements in order to move the switching device 1, 1' from the open position O into the closed position C and back by generating spring forces FF, switching forces FS, counter switching forces FS', resetting forces FR, and counter resetting forces FR' of a magnitude respectively meeting the respective requirements in the switching direction S or the counter switching direction S' and transferring them to the switching contact 6, 6', 6", 6"'.

Advantageously, the forces required to release any welding of the switching contacts 6, 6', 6", 6"' according to the invention or its contact element to the counter contact can be induced as quickly as possible into the contact area. Thus, a weld can be more easily broken. The increased rigidity also reduces the necessary travel of the actuator compared to prior-art switching devices in order to achieve the necessary distance between the contacts in the open state of the switching device. This allows the drive system and the actuator to be designed such that the actuator generates a greater speed than prior-art switching devices before acting on the contact, and is thus able to accelerate it like a higher pulse in order to break any welds between the contact and the counter contact.

What is claimed is:

1. A switching contact, comprising:

a plurality of layered spring elements including a first spring element and a second spring element extending longitudinally and parallel to one another and having a contact section and an actuation section disposed adjacent to the contact section, the contact section having a contact element, the actuation section less rigid in a switching direction in which the contact element moves toward a fixed counter contact element than an opposite counter switching direction in which the contact element moves away from the fixed counter contact element, the first spring element positioned closer to the fixed counter contact element than the second spring element and having a lower rigidity in the actuation section than the second spring element in a direction perpendicular to the first and second spring elements.

2. The switching contact of claim 1, wherein the actuation section has a brace structure.

3. The switching contact of claim 2, wherein the brace structure is formed as a bend on an edge of one of the plurality of spring elements.

4. The switching contact of claim 1, wherein the plurality of spring elements extend from an attachment end.

5. The switching contact of claim 1, wherein the first spring element protrudes beyond the second spring element.

6. The switching contact of claim 5, wherein the first spring elements forms an actuation end.

7. The switching contact of claim 6, wherein the second spring element is wider than the first spring element in the actuation section.

8. The switching contact of claim 6, wherein the second spring element is the same width as the first spring element in the actuation section.

9. The switching contact of claim 8, wherein the first spring element has a weakening structure.

10. The switching contact of claim 9, wherein the weakening structure is a slit running along the actuation section.

11. The switching contact of claim 10, wherein the plurality of spring elements further include a third spring element.

12. The switching contact of claim 11, wherein the first spring element is positioned between the second spring element and the third spring element.

13. The switching contact of claim 12, wherein the third spring element extends from the attachment end to the actuation section.

14. The switching contact of claim 1, wherein each of the plurality of spring elements has a plurality of switching units.

15. The switching contact of claim 14, wherein each of the switching units has a contact element.

16. An electrical switching device, comprising:

a switching contact having a plurality of layered spring elements including a first spring element and a second spring element extending longitudinally and parallel to one another and including a contact section and an actuation section disposed adjacent to the contact section, the contact section having a contact element, the actuation section less rigid in a switching direction in which the contact element moves toward a fixed counter contact element than an opposite counter switching direction in which the contact element moves away from the fixed counter contact element, the first spring element positioned closer to the fixed counter contact element than the second spring element and having a lower rigidity in the actuation section than the second spring element in a direction perpendicular to the first and second spring elements.

17. The electrical switching device of claim 16, further comprising a drive system, an actuation system, and a housing.

18. The switching contact of claim 1, wherein the contact element is disposed on the first spring element and extends from a surface of the first spring element toward the fixed counter contact element.

* * * * *